US005849442A

United States Patent [19]

Liu et al.

[11] Patent Number: 5,849,442

[45] Date of Patent: Dec. 15, 1998

[54] METHOD OF MANUFACTURING A FLAT PANEL FIELD EMISSION DISPLAY HAVING AUTO GETTERING

[75] Inventors: David Nan-Chou Liu, Fong-Yuan; Jammy Chin-Ming Huang, Taipei; Jyh-Haur Tyan, Hsinchu, all of Taiwan

[73] Assignee: Industrial Technology Research Institute, Hsin-Chu, Taiwan

[21] Appl. No.: 912,324

[22] Filed: Aug. 18, 1997

Related U.S. Application Data

[62] Division of Ser. No. 405,191, Mar. 16, 1995, Pat. No. 5,693,438.

[51] Int. Cl.[6] ..... G03K 5/00; H01J 1/62

[52] U.S. Cl. ..... 430/28; 430/25; 313/495; 313/497; 313/553; 313/558; 445/24; 445/41; 445/50

[58] Field of Search ..... 430/28, 25; 313/495, 313/497, 553, 558; 445/24, 41.5

[56] References Cited

U.S. PATENT DOCUMENTS

| | | | |
|---|---|---|---|
| 5,063,323 | 11/1991 | Longo et al. | 313/309 |
| 5,083,958 | 1/1992 | Longo et al. | 445/24 |
| 5,283,500 | 2/1994 | Kochanski | 315/58 |
| 5,453,659 | 9/1995 | Wallace et al. | 313/495 |
| 5,693,438 | 12/1997 | Liu et al. | 430/28 |

OTHER PUBLICATIONS

K. Derbyshire, "Beyond AMLEDS: Field Emission Displays?" Solid State Technology, vol. 37, No. 11, Nov. 1994, pp. 55–65.

*Primary Examiner*—John S. Chu
*Attorney, Agent, or Firm*—George O. Saile; Stephen B. Ackerman

[57] ABSTRACT

A new method for forming an anode plate for a color flat panel Field Emission Displays (FEDs) having improved gettering, was accomplished. The method involves forming on a transparent insulating plate (glass) an array of pixels of three phosphors comprising the primary colors and having in or/and around the array of pixels gettering material to provide more efficient gettering of volatile material from the FED cavity. The electrons are injected into the pixels when the electron field emitters are electrically accessed via the address and image forming circuits. The injected electrons heat and activate the gettering material in and around the pixels and provide very effective gettering in the FED cavity.

5 Claims, 5 Drawing Sheets

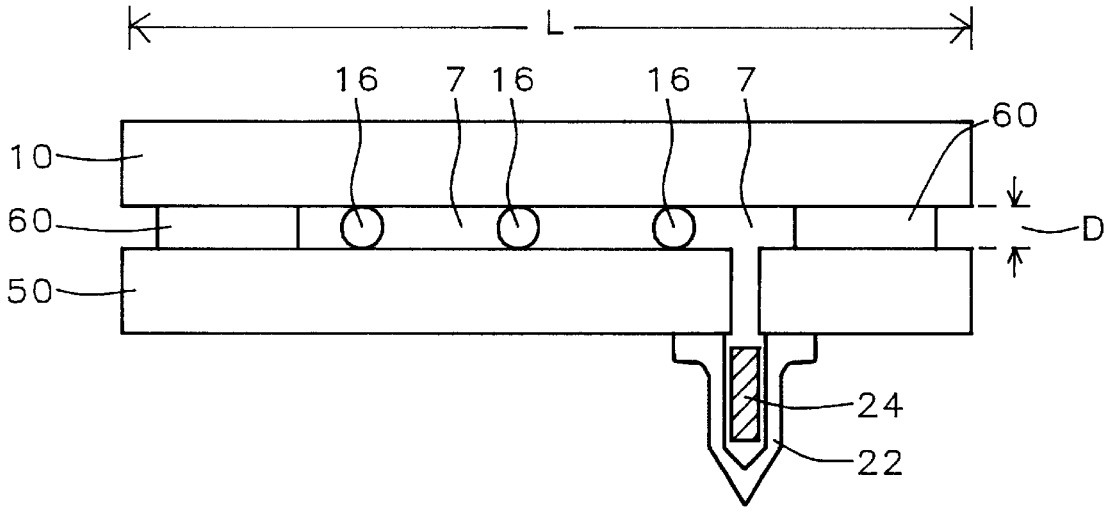
FIG. 1 – Prior Art
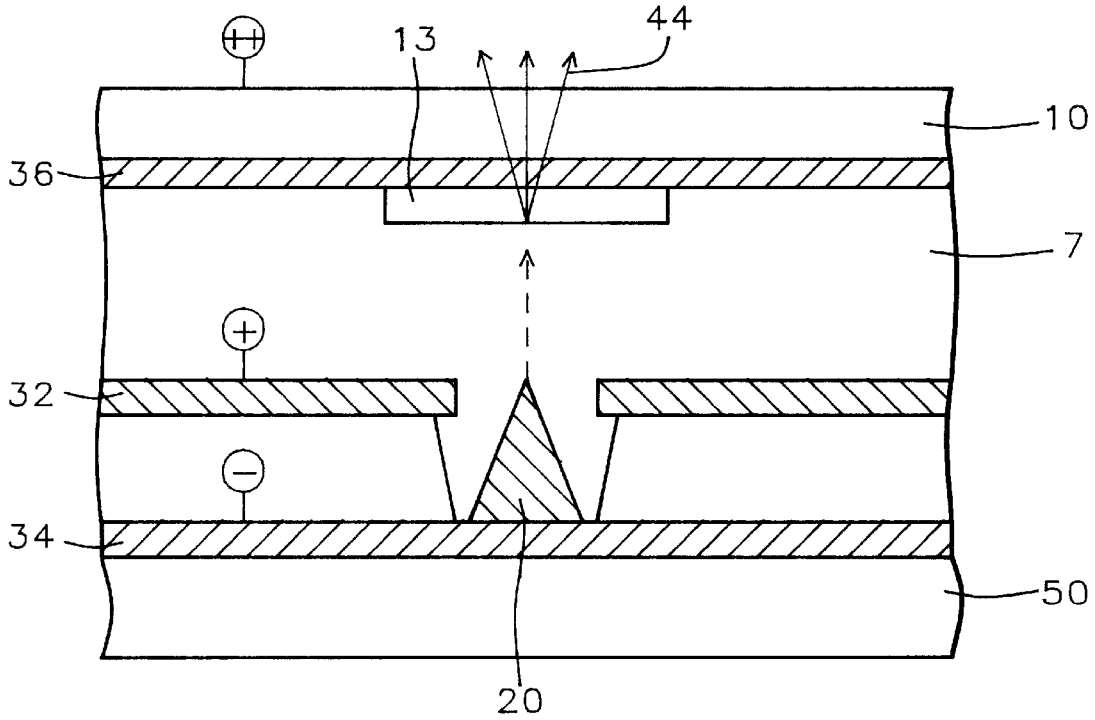
FIG. 2 – Prior Art

METHOD OF MANUFACTURING A FLAT PANEL FIELD EMISSION DISPLAY HAVING AUTO GETTERING

This is a Division of application Ser. No. 08/405,191 filed on Mar. 16, 1995, now U.S. Pat. No. 5,693,438.

BACKGROUND OF THE INVENTION

1 Field of the Invention

The present invention relates to Flat Panel Field Emission Displays (FPFEDs), and more particularly, to a method for manufacturing a FPFED having auto gettering for eliminating outgassed material from the active electronic device area of the flat panel display.

2. Description of the Prior Art

There is a strong need in the electronics industry for thin, lightweight display panels. For example, one application for low power, low cost flat panel displays (FPD) is in the computer industry for portable computers, such as laptop computers. The most commonly used display panel, at the current time, is the liquid crystal display (LCD), but because of the slow optical response time of the liquid crystal pixel to turn on or off (the discrete dots on the screen making up the image), and because of the relatively poor luminosity other display technologies are actively being explored.

One alternative display technology having the potential to provide the required faster response times and increased brightness is the Flat Panel Field Emission Display (FPFED), also referred to simply as a Field Emission Displays (FED). The flat panel FED can be viewed as an array of micro-miniature cold cathode electron emitters mounted on a substrate or backing plate from which emitted electrons are accelerated across the thickness of the evacuated panel to excite an cathodoluminescent material (phosphors) comprising the pixel (dot) on a transparent plate that serves as both the anode and the viewing screen. The array of very small conical shaped electron emitters are electrically accessed, by peripheral control and image forming circuits, using two arrays of conducting lines that form columns and rows. The array of column lines form the cathode contacts on which the conical electron emitters are formed. The array of row conducting lines form gate electrodes that are separated by a dielectric layer from the column lines. The column lines are formed on the backing plate, and both the row conducting lines and the insulator have opening over the column lines on which the electron emitter is formed. The edges of the openings in the row lines are in close proximity to the emitter tip, and function as the electrically addressable gate electrode or control grid for the individual electron emitters. A good review article entitled "Beyond AMLCDs: Field emission displays?", by K. Derbyshire, on flat panel FEDs can be found in Solid State Technology Vol 37, No. 11, Nov. 1994, pages 55 to 65.

The proper functioning of the field emission displays (FED) rely on maintaining an adequate vacuum within the cavity between the backing plate containing the array of electron field emitters and the transparent viewing plate coated with phosphors and serving also as the anode plate of the FED field emitters.

To better understand the problem, reference is made to the schematic cross sectional view of a prior art field emission panel (FED), as shown in FIG. 1. The cathode plate 50, containing the field emitters (not shown in FIG. 1), is separated from the anode plate 10 by sealing walls 60. Spacers 16 are usually placed between cathode and anode plates to prevent the atmospheric pressure (about 14.7 pounds/square inch) from distorting or breaking the relatively thin anode plate when the field emission panel (FED) is evacuated. The cavity between the plates is then evacuated through the exhaust tube 22 by vacuum pumping means and then sealed off to maintain a high vacuum in the FED. Unfortunately, virtual leaks or outgassing from the walls and materials from which the FED is fabricated can degrade the vacuum after sealing, and thereby destroy the intended function of the FED. To achieve and maintain a good vacuum it is common practice in the vacuum tube industry to utilize a gettering material, for example, such as barium (Ba) tantalum (Ta), titanium (Ti) and zirconium (Zr) to name a few. The getter also serves as a keeper to maintain a good vacuum during the intended life of the electronic vacuum device. The gettering material 24 for the FED of the prior art, as shown in FIG. 1 is usually positioned in the exhaust tube 22. This provides a convenient means for heating, and thereby activating the localized gettering source after the exhaust tube of the FED is sealed off.

Gettering material, localized in the exhaust tube, however, is not very effective in absorbing volatile material from the FED cavity because of design considerations. The FED are usually large in area and the spacing between cathode and anode plate is usually quite small. For example, as shown in FIG. 1, the cavity spacing D between the cathode plate 50 and anode plate 10 is typically only about 200 micrometers while the length L, as depicted in FIG. 1, can be greater than 20 centimeters. The outgassing during operation of the FED predominantly occurs from the heating of the phosphors on the anode plate by the electrons emitted from the cathode. Therefore, the outgassing material in the cathode/anode region is not very effectively removed because of the narrow passageway and the remote location of the gettering material. One method of providing improved gettering efficiency is described by R. T. Longo, U.S. Pat. No. 5,063,323, in which additional interconnecting channels are formed between the base for the field emitters and the gate electrode, thus providing additional channels for the evolving gas to escape. However, the gettering material is formed on the peripheral inner walls of the Longo field emitter device and still a considerable distance from the outgassing surfaces. Therefore, local undesirable pressure increases can still occur during operation of the FED.

Another method of removing the outgassed materials form a FED is described by G. P. Kochanski, U.S. Pat. No. 5,283,500, in which the field emitters and gate electrodes are composed of gettering materials, such as tantalum, titanium, niobium or zirconium.

To understand the nature of the gettering method of G. P. Kochanski, a greatly enlarge schematic cross sectional view is shown in FIG. 2 of a portion of the prior art FED of FIG. 1. Shown in FIG. 2, is one of the many field emitters 20 formed on the cathode electrode 34 and one of the many phosphor pixels 13 on the anode plate 10. During operation of the FED, electrons are ejected from the emitter 20 by applying a bias (in volt) between the gate electrode 32 and cathode electrode 34. The electrons are ejected into the space 7 and accelerated by means of a more positive voltage on the conducting layer 36 on anode plate 10, and thereby strike the phosphor pixel 13, generating the luminous flux 44. The high energy electrons also heat the phosphor 13 and portions of the anode plate 10 and thereby dislodge the trapped volatile gas molecules from the anode material. The G. P. Kochanski method is to form the field emitter 20 and the gate electrode from gettering material.

However, because the field emitter work function should be as low as possible for good electron emission efficiency and should not change during the intended useful life of the FED, gettering by the field emitters can be undesirable. Therefore, there is still a strong need in the industry to improved the gettering in a FED without significantly increasing the manufacturing complexity.

SUMMARY OF THE INVENTION

It is a principle object of this invention to provide a flat panel Field Emission Display (FED) structure with improved gettering (auto-gettering) and a method of manufacturing said flat panel FED.

It is the object of a first embodiment to incorporate the gettering material (getter) in the phosphor pixels on the anode plate of the FED to facilitate the auto gettering of volatile gasses during operation of the FED.

It is the object of a second embodiment to form a matrix of gettering regions adjacent to the matrix of phosphors pixels on the anode plate to also facilitate the gettering of volatile gases during operation of the FED.

It is the object of a third embodiment to provide an alternative method of forming the improved gettering structures of the first and second embodiments by selective deposition of the phosphors on the anode plate and gettering material by electrophoresis.

It is the object of a fourth embodiment to form a matrix of gettering regions adjacent to the matrix of phosphors pixels on the anode plate by electrophoresis to facilitate the gettering of volatile gases during operation of the FED.

It is still another object to achieve these structures in a cost effective manufacturing process.

In accordance with the first embodiment of this invention, a method is described for fabricating a matrix of pixel on the anode plate of the FED composed of mixtures of phosphor and gettering material. The method involves providing an optically transparent insulating plate, for example composed of glass, that also serves as the top plate and viewing screen of the FED. An optically transparent electrically conducting layer is coated on one side of the insulating plated. This conducting layer serves as the anode electrode for the field emitters on the cathode of the FED. Now, important to this invention, a first matrix of pixels composed of a mixture of a first phosphor and a gettering material is formed on the conducting layer. For example, a slurry composed of the first phosphor and getter can be coated on the conducting layer and then patterned using conventional photolithographic techniques and etching. Alternatively, screen printing, commonly used in the electronics industry can be used to form a patterned layer from the phosphor/getter slurry. The above method is then repeated a second and third time to form a matrix of pixels composed of a second and third phosphor with the gettering material mixed therein. The three types of phosphor are usually a red, green and blue phosphors commonly used in the color display and television industry for achieving the widest optical spectrum range. The anode plate is then baked to remove solvents and thereby complete the anode plate for the FED.

A second embodiment of this invention provides a method for forming a matrix of gettering regions on the anode plate. The matrix of getter regions are formed adjacent to the pixels composed of phosphors. The method of fabricating the anode plate begins by depositing a transparent electrically conducting layer on a insulating plate. The three matrices of pixels formed from the first, second and third phosphors (red, green and blue) are formed, as in the first embodiment, but without including the gettering material. The matrix of gettering regions is then formed adjacent to the phosphor pixels by coating a slurry composed of a fine powder of gettering material onto the conducting layer and then patterning by using photolithographic and etching techniques or by screen printing. The fabrication of the anode plates for the FED is completed by baking to remove the volatile gas product.

A third embodiment of the invention teaches a method of fabricating the anode plate, wherein the matrix of pixels, composed phosphors and gettering materials, are formed by selective deposition using electrophoresis. The method of fabricating the anode plate begins by depositing an optically transparent electrically conducting layer on an insulating plate. The conducting layer is then patterned to form an array of conducting stripes. A mixture composed of a first phosphor and gettering material is then selectively deposited by electrophoresis in a solution containing the mixture. The selective deposition is carried out on every third conducting stripe. The selective deposition is repeated a second and third time to form a second and third array of phosphors/getter mixture, thereby forming alternating arrays of pixels having different phosphors (e.g. red, green and blue) having gettering material. The anode plate of the FED is then completed by baking to remove the volatile material and form the array of pixels.

A fourth embodiment of this invention describes the method of forming an array of pixels having an adjacent array of gettering regions, as in the second embodiment, however the array of pixels composed of phosphors and the array of gettering regions are formed by the method of selective deposition using electrophoresis.

After forming the new and improved anode plate having the more effective automatic gettering (auto-gettering), the anode plate is positioned with the matrix or array of pixels facing and aligned to an array of gated electron field emitters on a cathode plate. The spacing between the anode and cathode plates is achieved by a sealing wall along the perimeter of the FED, which also serves to seal the FED cavity for evacuation. When the FED is evacuated and the field emitters are electrically accessed via the address and imaging circuits, the electrons that are inject into and excite the phosphors also heat and thereby activating the gettering material. The gettering material effectively getters the volatile gases evolving from the heated anode and cathodes.

BRIEF DESCRIPTION OF THE DRAWINGS

The invention is described in more detail in the preferred embodiments with reference to the attached drawings.

FIG. 1 shows a schematic cross sectional view of the prior art FED

FIG. 2 shows a greatly enlarged schematic cross sectional view of a portion of the prior art FED of FIG. 1.

DESCRIPTION OF THE PREFERRED EMBODIMENTS

Referring now to FIGS. 3 through 7 the more detailed method for fabricating an anode plate having pixel composed of phosphors and gettering material is described. Although the invention is described for a field emission display (FED) having pixels composed of three phosphors for producing colored images, it should be well understood by those skilled in the art that the invention also applies to single phosphor displays for making monochromatic displays. For example, a white phosphor, such as zinc beryllium zirconium silicate can be used to make white and black display panels. Although the invention is particularly useful in display panels having large surface to volume ratios, such as in FED, where outgassing can rapidly degrade vacuum quality, the auto gettering of, this invention, can be used in other types of vacuum devices were gettering of volatile materials is important.

Although the pixel is generally defined as any of the small discrete elements that together constitute an image on a screen, for the purpose of this invention, the term pixel is further defined as being the discrete elements composed of a single phosphor. Therefore, the individual discrete elements made from each of the three phosphors, such as the red, green and blue phosphors that generate the primary colors, are referred to in this invention as pixels. With this definition in mind, the description for making the anode plate composed of a matrix of pixels and having the improved gettering properties is as follows.

Figure 3:
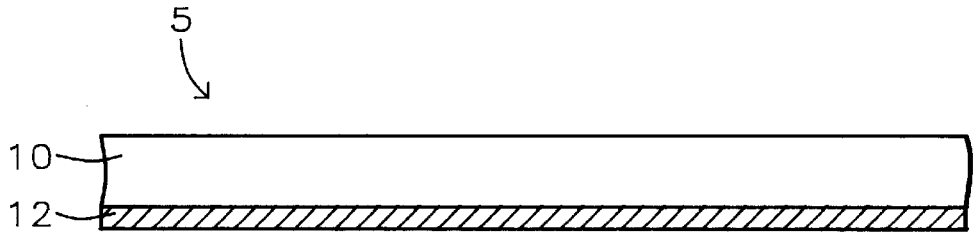
FIGS. 3 through 6 show a schematic cross sectional views of the first embodiment for forming the pixels having the mixture of phosphors and gettering material.

Referring now to FIG. 3, a schematic cross sectional view is shown of the starting substrate from which the anode plate 5 for a field emission display (FED) is constructed. For simplicity of discussion, only a portion of the anode plate is depicted in the Figs having a few of the many pixels that are usually fabricated on the anode plate. The structure consist of an optically transparent insulating plate 10, preferably composed of a good optical quality glass and having a thickness of between about 0.7 to 1.1 millimeters. An electrically conducting layer 12, which is also optically transparent, is then deposited on a principle surface of the insulating plate 10, as shown in FIG. 3. The material of choice for layer 12 is, for example, an indium tin oxide (ITO) composed of a mixture of $In_2O_3$ and $SnO_2$. This conducting glass will eventually serve as the anode for the array of electron field emitters in the FED. The method of choice for depositing the ITO is by sputter deposition, and the preferred thickness of layer 12 is between about 500 to 1000 Angstroms.

Next, and important to this invention, a slurry composed of a mixture of a fine powder of a first phosphor and a fine powder of a gettering material is made using a polyvinyl alcohol (PVA) and containing an aluminium dichromate for cross-linking. The amount of gettering material in the phosphor is chosen to maintain a required vacuum level in the finished FED, but by way of example only, the atomic percent of gettering material in the phosphor would generally be in the range of between about 0.1 to 1.0 percent. The amount of phosphor/getter material mixed with the PVA solution is between about 30% weight (% wt) to 70% weight of PVA solution. The PVA solution is prepared by 7% PVA in 93% water. The amount of aluminium dichromate added to the slurry is between about 1.0 to 10.0% wt. The order in which the different phosphors are used to form the pixels is not relevant to the invention. For example, the first phosphor can be one of the red, green or blue phosphors commonly used in the display industry for making televisions, however, for the sake of this invention the red phosphor is selected as the first phosphor. The gettering material is preferably a getter alloy. For example, one such alloy is manufactured by the SAES Corporation of Milano, Italy, and is composed of 70% zirconium, 24.6% vanadium and 5.4% iron and designated by SAES Corp. as getter St707. Alternatively, other getter materials can also be used, such as a zirconium/aluminium (Zr/Al) alloy also manufactured by the SAES Corp., and designated as St101. Still other common useful getter materials include titanium (Ti), tantalum (Ta) and zirconium (Zr) and the like can be used.

Figure 4:
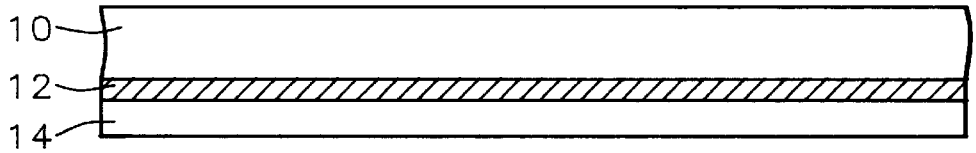

As shown in FIG. 4, the slurry is next coated on the conducting layer 12, for example, by spin coating, a method commonly used in the semiconductor industry for coating photoresist and spin-on-glass. The coating is then prebaked resulting in a composite phosphor/getter layer 14 having a preferred thickness of between about 3.0 to 10.0 micrometers.

Figure 5:
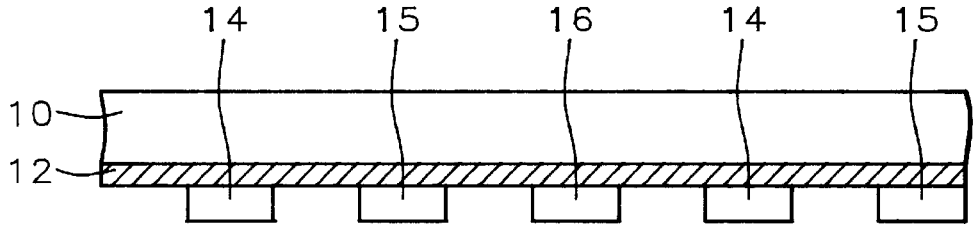

The composite first phosphor/getter layer 14 is then patterned using photolithographic techniques as is also commonly used in the color Cathode ray tube industry, to form a first matrix of pixels composed, for example, from the red phosphor, as labeled 14 in FIG. 5. The photolithographic technique uses a light source to expose the PVA and AD resulting in crosslinking. A water rinse is used to dissolve the layer in the unexposed areas forming the pattern.

Next, a second matrix of pixels are formed on the conducting layer 12 using the same process as above, but using now a second phosphor, such as a green phosphor and gettering material. The slurry composed of a second phosphor and a gettering material is coated on the conducting layer 12 forming a composite second phosphor/getter layer 15. The layer is then patterned to form a second matrix of pixels 15, as is also shown in FIG. 5. Each pixel of the second matrix of pixels 15 is aligned to and adjacent to a corresponding pixel in the first matrix of pixels 14, as is shown in FIG. 5. The process above for forming the matrix of pixels is then repeated still a third and final time to form a matrix of pixels from a third phosphor/getter layer 16, the third matrix of pixels being aligned to and adjacent to the second matrix of pixels, as shown in FIG. 5. The third phosphor, for example being a blue phosphor. The anode plate having the completed matrix of pixels thereon is then baked at a temperature of between about 400° to 450° C. for a time of between about 1.0 to 2.0 hours to remove the volatile material and form a stable phosphor/getter pixel structure. This completes the fabrication of the anode plate by the method of this invention, having a matrix of pixels composed of a gettering material and phosphors of the three primary colors required for fabricating a color FED.

Alternatively, the matrix of pixels formed on the anode plate by the above method can, also, be formed by the methods of screen printing also using a slurry or paste composed of a mixture of phosphor and gettering material. In the screen printing method the screen mask is aligned over the conducting layer 12 and the slurry or paste is applied to form the matrix of pixels. The screen printing method is repeated for each of the three matrix of pixels, aligning one matrix of pixels to the other.

Figure 6:
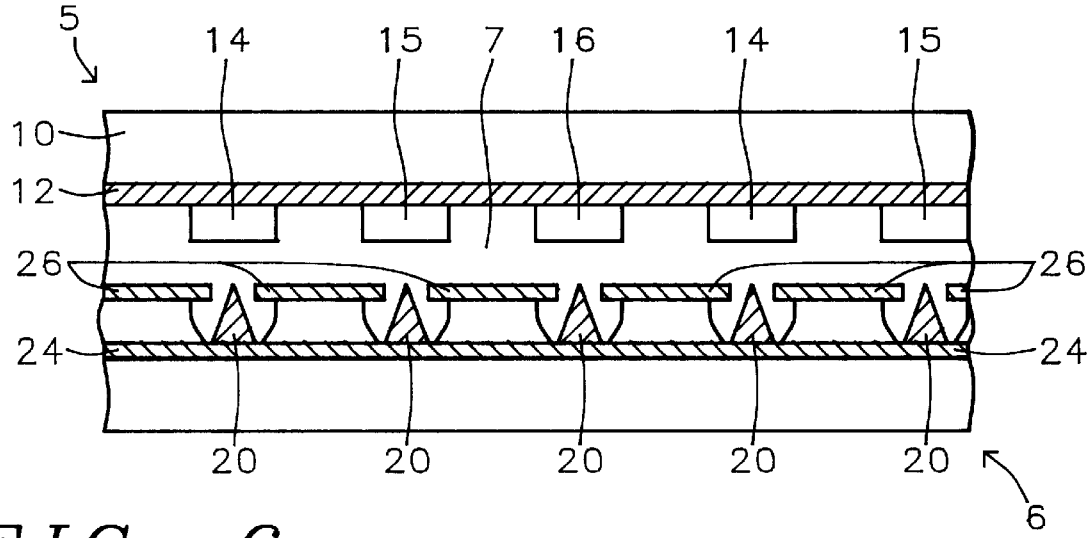

Referring now to FIG. 6, a completed FED is shown utilizing the anode plate of this invention. The anode plate 5 is positioned over a base plate or cathode plate 6, previously fabricated and containing an array of electron field emitters 20. The matrix of pixels 14, 15 and 16 are aligned over the emitters and a sealing wall (not shown in FIG. 6) alone the perimeter of the FED maintain the spacing between the anode 5 and cathode 6. The sealing wall also maintains the vacuum in the FED cavity 7 after the cavity is evacuated and sealed off. After the cavity is sealed off, virtual leaks or outgassing from the surfaces in the cavity can degrade the vacuum. For example, when the FED is powered up the address and image forming circuits (not shown) provide the bias between the cathode electrode 24 and gate electrode 26 that eject electrons into the space 7. The electrons are then accelerated by the anode electric field and strike the phosphor (pixel) to generate the luminous flux that form the images. Unfortunately, the electrons also heat the phosphor that result in outgassing that increase the pressure. The mean free path of the electron is reduced and if the pressure gets high enough, a plasma can result that can degrade or destroy the FED. Therefore, as described in this invention, by including the getter material on the anode, and more specifically in the phosphors it is possible to achieve automatic gettering (auto gettering). When the electrons heat up the phosphor containing the gettering material the getter material is activated and effectively getter the volatile molecules at the anode surface, thus minimizing the outgassing problems. Since the gettering material, in this invention, is very near the outgassing surfaces (anode and cathode), unlike traditional method where the getter is in the exhaust port, the gettering efficiency is substantially improved.

Referring now to FIGS. 7 through 10, a second embodiment is described in which the gettering region are formed on the anode plate outside the pixel area and can be separately activated to provide gettering in the FED cavity. Because many of the techniques and process of the second embodiment are similar to the first embodiment, only the differences will be described in detail.

Figure 7:
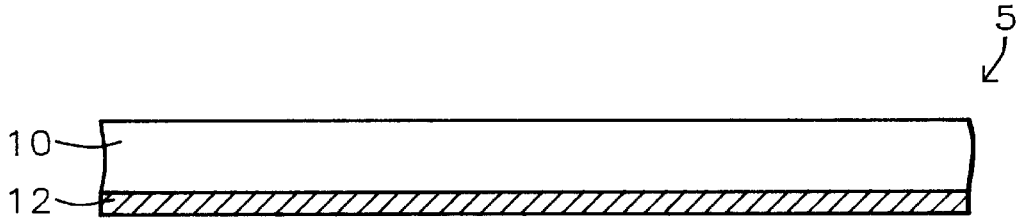
FIGS. 7 through 10 show a schematic cross sectional view of the second embodiment having an array of gettering regions formed adjacent to the matrix of pixels having only phosphors.

Referring now to FIG. 7, the method of forming an anode plate 5 starts by providing a good optical quality transparent plate 10, as in the first embodiment. A transparent electrically conducting layer 12, such as indium tin oxide (ITO), and having a thickness of between about 500 to 1000 Angstroms is deposited on the insulating plate 10 and serves as the anode electrode for the field emitters of the FED, as is also described in the first embodiment.

Figure 8:
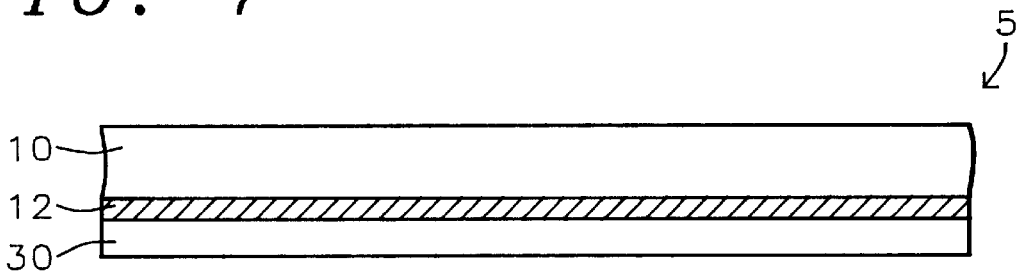
Figure 9:
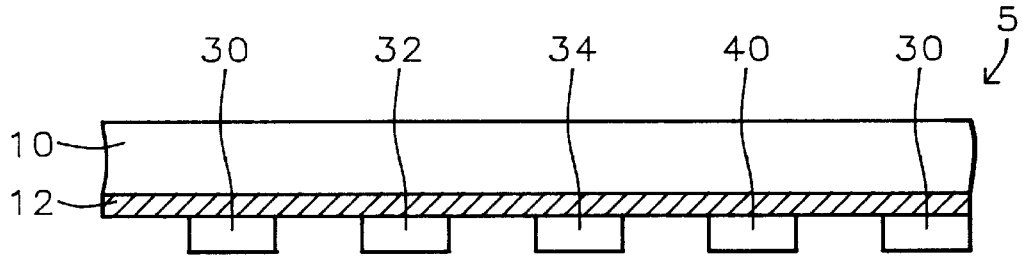

Referring to FIG. 8, a slurry is formed from a first phosphor, such as a red phosphor, and coated on the conducting layer 12 to form a first phosphor layer 30 having a thickness of between about 3.0 to 10 micrometers. The slurry is formed by mixing a fine powder of the phosphor in a polyvinyl alcohol (PVA) containing a cross-linking agent such as aluminium dichromate (AD). The amount of phosphor mixed with the PVA solution is between about 30% of phosphor to about 70% of PVA solution. The PVA solution is composed of 7% PVA powder and 93% water. The first phosphor layer 30 is patterned by photolithography to form a first matrix of pixels 30, as shown in FIG. 9. Alternatively, the pattern of first matrix of pixels can also be formed by using screen printing. The process above is again repeated using a new slurry formed from a second phosphor, such as a green phosphor. The new phosphor layer 32 is deposited and patterned forming a second matrix of pixels 32, also depicted in FIG. 9. The individual pixels in the second matrix of pixels are aligned to and adjacent to corresponding pixels in the first matrix 30, as shown in FIG. 9. The process is repeated a third and final time to form a third matrix of pixels 34, from a third phosphor layer 34, thereby completing the necessary matrix of pixels for generating a colored image from the primary colors.

A matrix of gettering material regions 40 are now formed aligned to and adjacent to the matrix of pixels formed from the phosphor using the coating and patterning method similar to the method of forming the phosphor pixels. The composition of slurry is between about 30% wt of gettering material in about 70% wt of PVA, and aluminium dichromate is added to improve the cross-linking.

Figure 10:
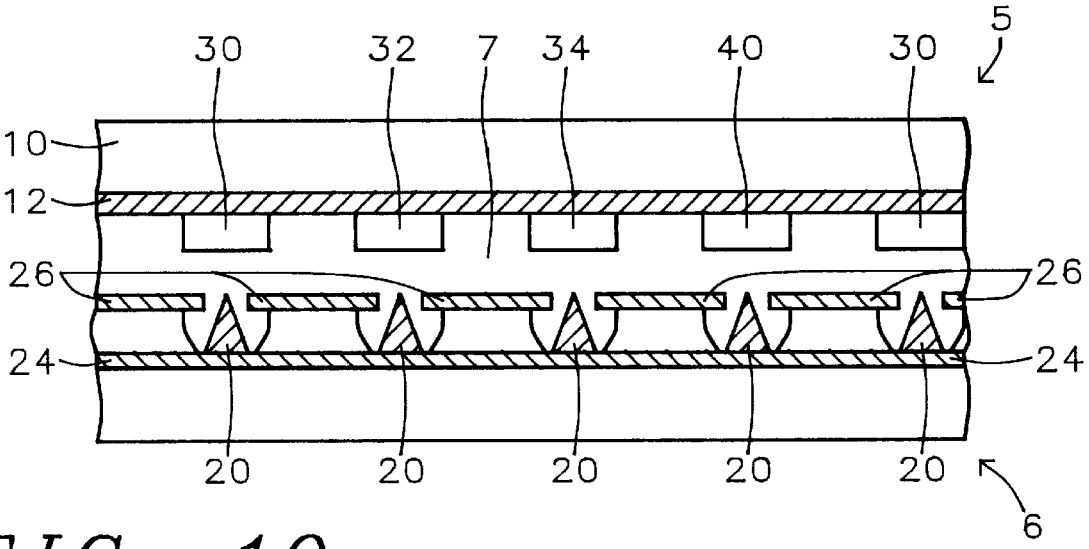

Referring now to FIG. 10, a schematic cross sectional view of a portion of a final assembled FED is shown. The method of operation and the advantages of the getter material on the anode plate are the same as in the first embodiment. However, the getter regions in this embodiment are separate from the phosphor pixels and provide added benefit. For example, the getter can be separately activated to getter volatile material in the cavity.

Referring now to FIGS. 11 through 14, a third embodiment is described in which the phosphor/getter mixture is deposited by selective deposition using electrophoresis. Since the same slurries are used as in the first embodiment, they are not described here in any detail.

Figure 11:
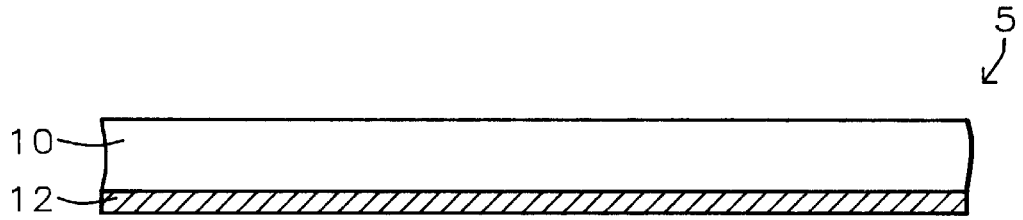
FIGS. 11 through 14 show a schematic cross sectional view of the third embodiment in which the array of pixels having mixtures of phosphors and gettering material are formed by electrophoresis.
Figure 12:
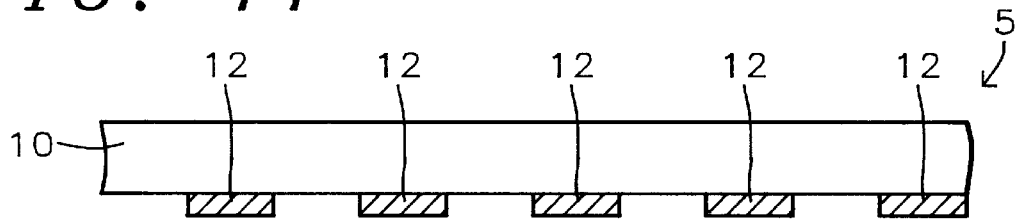

Referring now to FIG. 11, a schematic cross sectional view is shown of partially completed anode plate 5, as described in the first embodiment is provided. Briefly, the anode plate 5 is comprised of a transparent insulating plate 10 having a optically transparent layer 12, composed of indium tin oxide (ITO) deposited thereon, as detailed in the first embodiment. In this embodiment the ITO layer 12 is now patterned to form an array of closely spaced conducting stripes 12, as shown in FIG. 12. The patterning is achieved by conventional photoresist masking and etching. The preferred method of etching the ITO layer 12 is by using a wet etch, such as in hydrochloric acid or by dry etching in a plasma using methane ($CH_4$)

Figure 13:
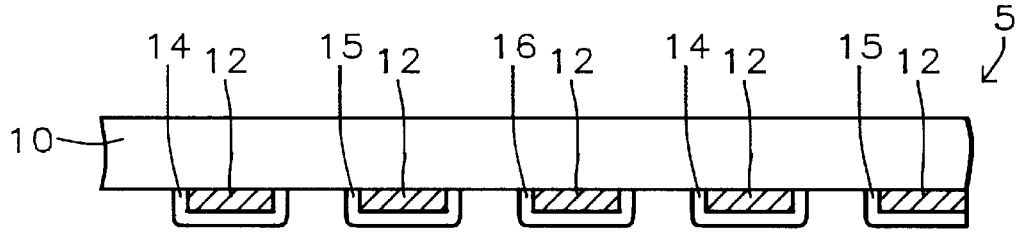

Every third stripe 12 is now selectively coated with a mixture of a first phosphor and a gettering material to form a first phosphor/getter layer 14 on the conducting stripe 12, as shown in FIG. 13. The method is repeated to selectively coat a second phosphor/getter layer 15 and a third phosphor/getter layer 16 on alternate conducting strips 12, as is also depicted in FIG. 13.

The method used to selectively deposit the phosphors is by electrophoresis, in which the anode plate 5 having the patterned conductive stripes 12 thereon, is immersed in a bath containing the phosphor/ getter slurry. Selective contact is maked electrically to the conducting strips 12 that are to be coated. Alternatively, a patterned photoresist mask can be used, exposing only the conducting strips 12 that are to be coated, and then electrical contact is made to all of the conducting stripes 12. The anode plate 5 is then immersed in the bath serving as one of the bath electrodes. A second electrode is immersed in the bath to complete the circuit, and then a voltage is applied across the electrode to achieve the electrophoresis and thereby provide the means for selectively coating the conducting stripes 12.

Figure 14:
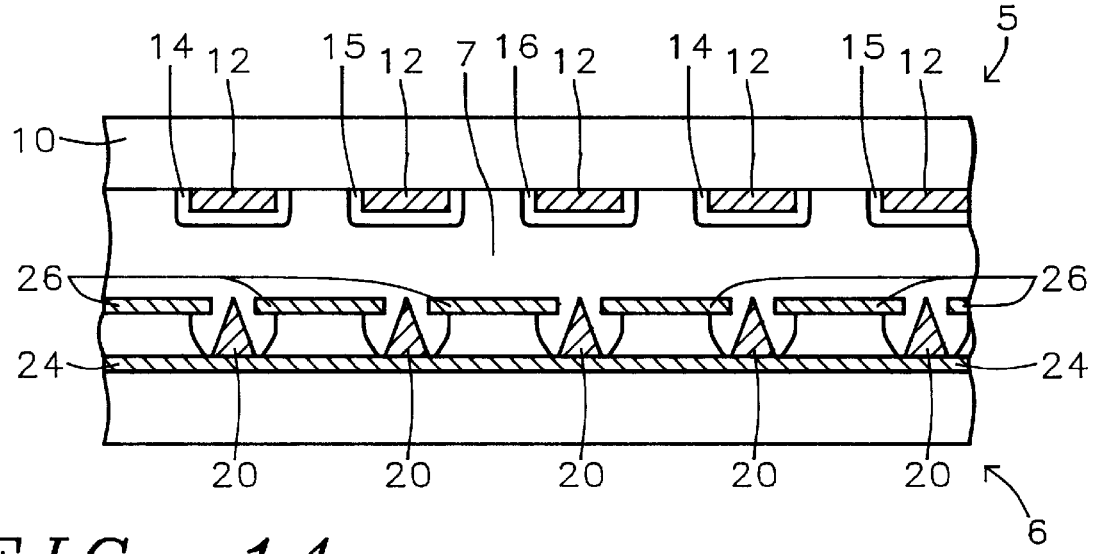

Referring now to FIG. 14, a schematic cross sectional view of a portion of the final assembled FED is shown having the new anode plate 5. The labeling of FIG. 14, the method of operation and the advantages of the getter material on the anode plate are described in the first embodiment.

Referring now to FIGS. 15 through 18 still a fourth embodiment of the invention is described in which the patterned conducting stripes of the third embodiment and the method of forming separate gettering regions on the anode by the method of the second embodiment is utilized.

Figure 15:
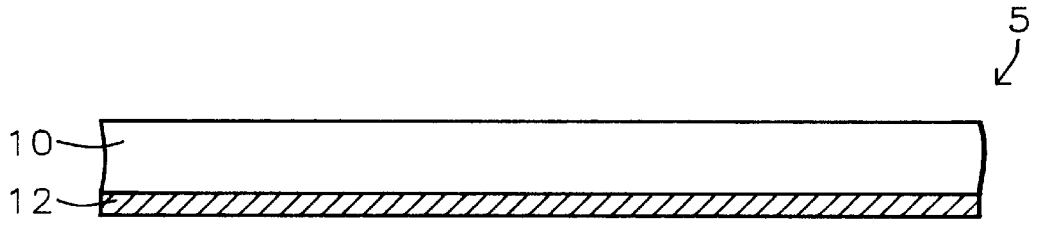
FIGS. 15 and 16 show a schematic cross sectional view of the fourth embodiment in which the array of phosphor pixels have an adjacent array of gettering regions formed by electrophoresis.
Figure 16:
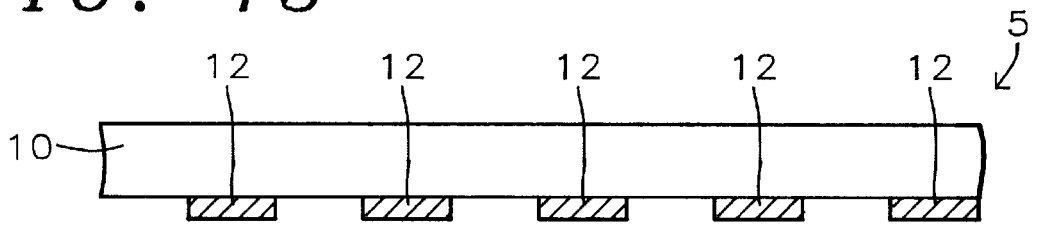

The partially completed anode plate 5 as described in detail in the first embodiment is shown in FIG. 15. The anode plate 5 is formed, as before, from an optical quality transparent insulator plate 10 having an optically transparent electrically conducting layer 12 (first embodiment). The conducting layer 12 is then patterned to form electrically conducting stripes 12, as shown in FIG. 16 and as described in the third embodiment.

Figure 17:
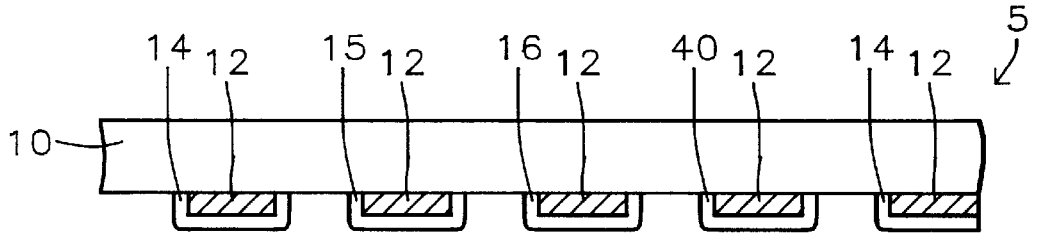

Every fourth conducting stripe 12 is now selectively coated with a slurry composed of a first phosphor first phosphor layer 14 on every fourth conducting stripe 12, as shown in FIG. 17. The method is repeated to selectively coat a second phosphor layer 15 and a third phosphor layer 16 on alternate conducting stripes 12, as is also depicted in FIG. 17.

The method used to selectively coat the conducting stripes 12 is described in the second embodiment. Briefly, the anode plate 5 having the patterned conductive stripes 12 thereon, is immersed in a bath containing the particular phosphor slurry. Selective contact is making electrically to the conducting strips 12 that are to be coated. Alternatively, a patterned photoresist mask can be used, exposing only the conducting stripes 12 that are to be coated. The anode plate 5 is then immersed in the bath serving as one of the bath electrodes. A second electrode is immersed in the bath to complete the circuit, and then a voltage is applied across the electrode to achieve the electrophoresis and thereby provide the means for coating the conducting stripes 12.

The anode plate 5 having an array of phosphor pixels is now completed by forming a array of gettering material regions 40 on the remaining uncoated conducting stripes 12, as shown in FIG. 17. The array of gettering material regions by a method similar to the method for forming the phosphor pixels. A bath having a slurry formed only from the gettering material is used. The anode plate 5 is immersed in the bath and forms one electrode in the bath while a second electrode is immersed in the bath to complete the circuit. The deposition is time to achieve the required thickness of the gettering material. The preferred thickness being between about 3.0 to 10.0 micrometers.

Figure 18:
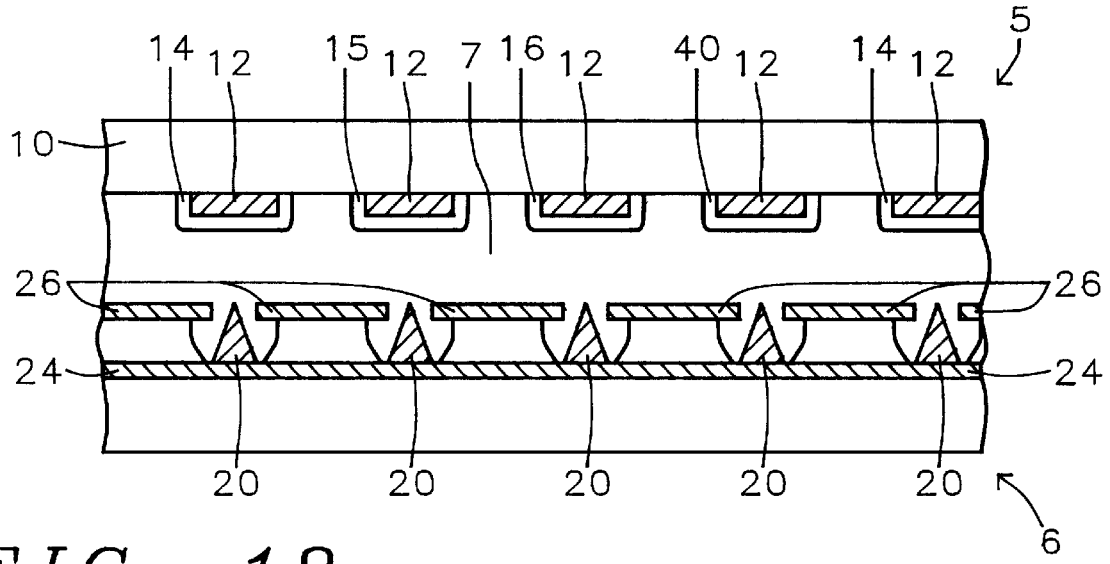

The completed FED using the anode plate 5 of this embodiment is shown in FIG. 18, and the advantages of providing the gettering in close proximity to the phosphor pixels is as described in the earlier embodiment.

While the invention has been particularly shown and described with reference to the preferred embodiments thereof, it will be understood by those skilled in the art that various changes in form and details may be made without departing from the spirit and scope of the invention.

What is claimed is:

1. A method for fabricating an anode plate for a field emission display (FED) having phosphor and gettering material thereon, comprising the steps of:

providing an optically transparent insulating plate;

depositing an electrically conducting layer being optically transparent on a principle surface of said insulating plate;

patterning by masking and etching said conducting layer forming an array of parallel conducting stripes on said insulating plate;

selectively coating a mixture composed of a first phosphor and a gettering material on every third a conducting strip in said array of conducting stripes, and thereby forming a first array of pixels composed of said mixture on said electrically conducting stripes;

selectively coating a mixture composed of a second phosphor and said gettering material on an array of conducting stripes adjacent to said first array of pixels, and thereby forming a second array of pixels;

selectively coating a mixture composed of a third phosphor and said gettering material on the remaining array of conducting stripes, and thereby forming a third array of pixels;

baking said insulating plate having said array of pixels formed from alternating stripes of said first, second and third phosphors containing said gettering material, and thereby completing said anode plate.

2. The method of claim 1, wherein said electrically conducting layer is composed of indium tin oxide (ITO).

3. The method of claim 1, wherein said selective coating is performed by electrophoresis in a bath containing a slurry composed of said phosphors and gettering material.

4. The method of claim 1, wherein said gettering material is a composition of zirconium, vanadium and iron (Zr-V-Fe).

5. The method of claim 1, wherein said first, second and third phosphors are a red, green and blue phosphor.

* * * * *